US007176639B2

(12) United States Patent
Hu et al.

(10) Patent No.: US 7,176,639 B2
(45) Date of Patent: Feb. 13, 2007

(54) ELECTRONIC BALLAST AND CONTROLLING METHOD THEREOF

(75) Inventors: Xiao-Ju Hu, Taoyuan Shien (TW); Chen-Yang Liu, Taoyuan Shien (TW); Jian-Ping Ying, Taoyuan Shien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 105 days.

(21) Appl. No.: 10/862,446

(22) Filed: Jun. 8, 2004

(65) Prior Publication Data

US 2005/0179403 A1 Aug. 18, 2005

(30) Foreign Application Priority Data

Feb. 12, 2004 (TW) ..... 93103397 A

(51) Int. Cl.
*H05B 37/02* (2006.01)

(52) U.S. Cl. ..... 315/307; 315/291; 315/209 R

(58) Field of Classification Search ..... 315/224, 315/225, 291, 307, 308, 219, 209 R, 244, 315/276

See application file for complete search history.

(56) References Cited

U.S. PATENT DOCUMENTS 5,789,866 A * 8/1998 Keith et al. ..... 315/209 R
5,920,155 A * 7/1999 Kanda et al. ..... 315/307
6,111,369 A 8/2000 Pinchuk et al. ..... 315/307

* cited by examiner

*Primary Examiner*—Wilson Lee
(74) *Attorney, Agent, or Firm*—Harness, Dickey & Pierce, P.L.C.

(57) ABSTRACT

An improved electronic ballast for providing an electrical energy to a fluorescent lamp circuit is provided. It includes a pre-heating inductor; a first resonant circuit connected to the pre-heating inductor in parallel and coupled to the fluorescent lamp circuit for pre-heating the fluorescent lamp circuit according to a first resonant frequency; a second resonant circuit coupled to the fluorescent lamp circuit for igniting the fluorescent lamp circuit according to a second resonant frequency; and a driving circuit coupled to the second resonant circuit for continuously providing the electrical energy to the first resonant circuit and the second resonant circuit respectively according to the first resonant frequency and the second resonant frequency.

16 Claims, 4 Drawing Sheets

ELECTRONIC BALLAST AND CONTROLLING METHOD THEREOF

FIELD OF THE INVENTION

The present invention relates to an electronic ballast and its controlling method, and more specifically to the application of fluorescent lamps with filaments.

BACKGROUND OF THE INVENTION

A fluorescent lamp is an evacuated glass tube with a small amount of mercury in the tube. The tube is line with an adherent layer of a mixture of phosphors. Some of the mercury vaporizes at a low pressure within the tube and then a filament or cathode in each end of the tube is heated to emit electrons into the tube, which ionizes the gas. A high voltage between the filaments causes the mercury ions to conduct current, producing a glow discharge that emits ultraviolet light. The ultraviolet light is absorbed by the phosphors and re-emitted as visible light.

It is well known that if the ballasts are used in the applications where they are cycled on and off frequently, the life of the lamp will be reduced, no matter what type of ballast is installed: instant or rapid start.

To improve this defect, a new ballast which makes use of the programmed starting is provided. This kind of ballast can extend the life of the fluorescent lamp by more than 50 percent in these applications and reduce the energy and replacement costs. It has a precise starting scenario that breaks the starting process into unique well-defined phases so that the pitfalls of other starting methods are eliminated.

Please refer to FIG. 1, which shows a conventional electronic ballast according to the prior art of U.S. Pat. No. 6,111,369. The electronic ballast 10 is composed of a driving circuit 11, a pre-heating circuit 12, and a discharging circuit 13. As mentioned before, the operation process of the electronic ballast 10 is divided into two phases:

(1)The pre-heating phase

When the generator 113 generates a first frequency signal, the voltage drop across the primary coils 125 of the transformer increases. A current is generated in the secondary coils 121, 122, and 123 of the transformer. The current flows through the filament 141, 142, 151, and 152 to pre-heat them until the cathodes' temperature is at least 700 degrees centigrade.

In this phase, the voltage of the node a relative to the node b is generally similar to the voltage of the node c relative to the node b. Although there is a relatively high current flow through the primary coils 125 of the transformer, there is nevertheless only a very small voltage drop between the node a and the node c. Therefore, there is also only a small voltage drop across the bulbs 14 and 15 coupled in series between the node a and the node c. The resultant small voltage drop is desirable because it can avoid the pre-ignition of the bulbs 14 and 15.

(2)The ignition and normal operation phase

After the pre-heating phase is completed, the first frequency signal, the output of the generator 113, is changed preferably smoothly to a second frequency signal. The second frequency signal causes the pre-heating circuit 12 to stop resonating and activate the discharging circuit 13 to increase the voltage drop across the capacitor 132-which is substantially equal to the voltage drop across the bulbs 14 and 15-to a magnitude sufficient to initiate the ignition of the filaments of the bulbs 14 and 15.

In this phase, the termination of the pre-heating circuit 12 causes a significant decrease of the voltage across the secondary coils 121, 122, and 123 of the transformer as well as a corresponding decrease of the current flowing through the filaments 141, 142, 151, and 152. However, the voltage drop across the filaments still exists. Furthermore, the voltage stress of the capacitor 124 in the pre-heating circuit 12 is still at a high level, which is another defect of this prior art.

Please refer to FIG.2, which shows another conventional electronic ballast according to the prior art of U.S. Pat. No. 5,920,155. The electronic ballast 20 is composed of a main inverter 21 and a filament inverter 22. The operation of the electronic ballast 20 with the two phases mentioned before still has similar defects.

SUMMARY OF THE INVENTION

It is the main object of the present invention to provide a new electronic ballast, which decreases the voltage drop across the filaments, the voltage stress of the resonant capacitor in the filament resonant tank, and the power dissipation of the filaments.

It is another object of the present invention to provide a controlling method of an electronic ballast, which reduces or eliminates the auxiliary heating current completely.

According to the main object of the present invention, the electronic ballast for providing an electrical energy to a fluorescent lamp circuit includes a pre-heating inductor; a first resonant circuit connected to the pre-heating inductor in parallel and coupled to the fluorescent lamp circuit for pre-heating the fluorescent lamp circuit according to a first resonant frequency; a second resonant circuit coupled to the fluorescent lamp circuit for igniting the fluorescent lamp circuit according to a second resonant frequency; and a driving circuit coupled to the second resonant circuit for continuously providing the electrical energy to the first resonant circuit and the second resonant circuit respectively according to the first resonant frequency and the second resonant frequency.

Preferably, the fluorescent lamp circuit includes at least a fluorescent lamp and at least two pre-heating coils, and the winding of each pre-heating coil is equal.

Preferably, the first resonant circuit includes a first resonant capacitor and a first resonant inductor connected in series, wherein the first resonant capacitor is connected to the ground with the pre-heating capacitor, the first resonant inductor serves as a primary winding of a first transformer, and each pre-heating coil serves as a secondary winding of the first transformer.

Preferably, the electronic ballast further includes a first switch connected between the pre-heating inductor and the ground in series and being turned on when the fluorescent lamp circuit is pre-heated by the first resonant circuit and turned off after the fluorescent lamp circuit is ignited by the second resonant circuit for eliminating a current passing through the pre-heating inductor and filaments of the fluorescent lamp circuit.

Preferably, the second resonant circuit includes a second resonant capacitor connected to the fluorescent lamp circuit in parallel and a second resonant inductor serving as a primary winding of a second transformer, and the pre-heating inductor serves as a secondary winding of the second transformer.

Preferably, the driving circuit includes a pair of blocking capacitors coupled to a DC voltage source and including a first blocking capacitor and a second blocking capacitor connected in series; a pair of switches connected to the pair of blocking capacitors in parallel and including a second switch and a third switch connected in series, wherein the second switch and the third switch have a controlling terminal respectively; and a controlling circuit coupled to each controlling terminal for switching the second switch and the third switch alternatively.

According to the main object of the present invention, the electronic ballast for selectively eliminating a current passing through filaments of a fluorescent lamp circuit includes a pre-heating inductor; a first resonant circuit connected to the pre-heating inductor in parallel and coupled to the fluorescent lamp circuit for pre-heating the fluorescent lamp circuit according to a first resonant frequency; a second resonant circuit coupled to the fluorescent lamp circuit for igniting the fluorescent lamp circuit according to a second resonant frequency; a driving circuit coupled to the second resonant circuit for continuously providing an electrical energy to the first resonant circuit and the second resonant circuit respectively according to the first resonant frequency and the second resonant frequency; and a first switch connected between the pre-heating inductor and the ground in series and being turned on when the fluorescent lamp circuit is pre-heated by the first resonant circuit and turned off after the fluorescent lamp circuit is ignited by the second resonant circuit for selectively eliminating the current passing through the pre-heating inductor and filaments of the fluorescent lamp circuit.

Preferably, the fluorescent lamp circuit includes at least a fluorescent lamp and two pre-heating coils, and the winding of each pre-heating coil is equal.

Preferably, the first resonant circuit includes a first resonant capacitor and a first resonant inductor connected in series, wherein the first resonant capacitor is connected to the ground with the pre-heating capacitor, the first resonant inductor serves as a primary winding of a first transformer, and each pre-heating coil serves as a secondary winding of said first transformer.

Preferably, the second resonant circuit includes a second resonant capacitor connected to the fluorescent lamp circuit in parallel and a second resonant inductor serving as a primary winding of a second transformer, and the pre-heating inductor serves as a secondary winding of said second transformer.

Preferably, the driving circuit includes a pair of blocking capacitors coupled to a DC voltage source and including a first blocking capacitor and a second blocking capacitor connected in series; a pair of switches connected to the pair of blocking capacitors in parallel and including a second switch and a third switch connected in series, wherein the second switch and the third switch have a controlling terminal respectively; and a controlling circuit coupled to each controlling terminal for switching the second switch and the third switch alternatively.

According to another object of the present invention, the controlling method of an electronic ballast providing an electrical energy to a fluorescent lamp circuit, wherein the electronic ballast includes a pre-heating inductor, a first resonant circuit connected to the pre-heating inductor in parallel and coupled to the fluorescent lamp circuit, a second resonant circuit coupled to the fluorescent lamp circuit, a driving circuit coupled to the second resonant circuit, and a switch connected between the pre-heating inductor and the ground in series, includes the steps of turning on the switch through a first resonant frequency; pre-heating the fluorescent lamp circuit according to the first resonant frequency by the first resonant circuit; igniting the fluorescent lamp circuit according to a second resonant frequency by the second resonant circuit; and turning off the switch for eliminating a current passing through the pre-heating inductor and filaments of the fluorescent lamp circuit.

Preferably, the first resonant frequency and the second resonant frequency are provided by a controlling circuit.

Preferably, the controlling circuit respectively and continuously provides the first resonant frequency and the second resonant frequency.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
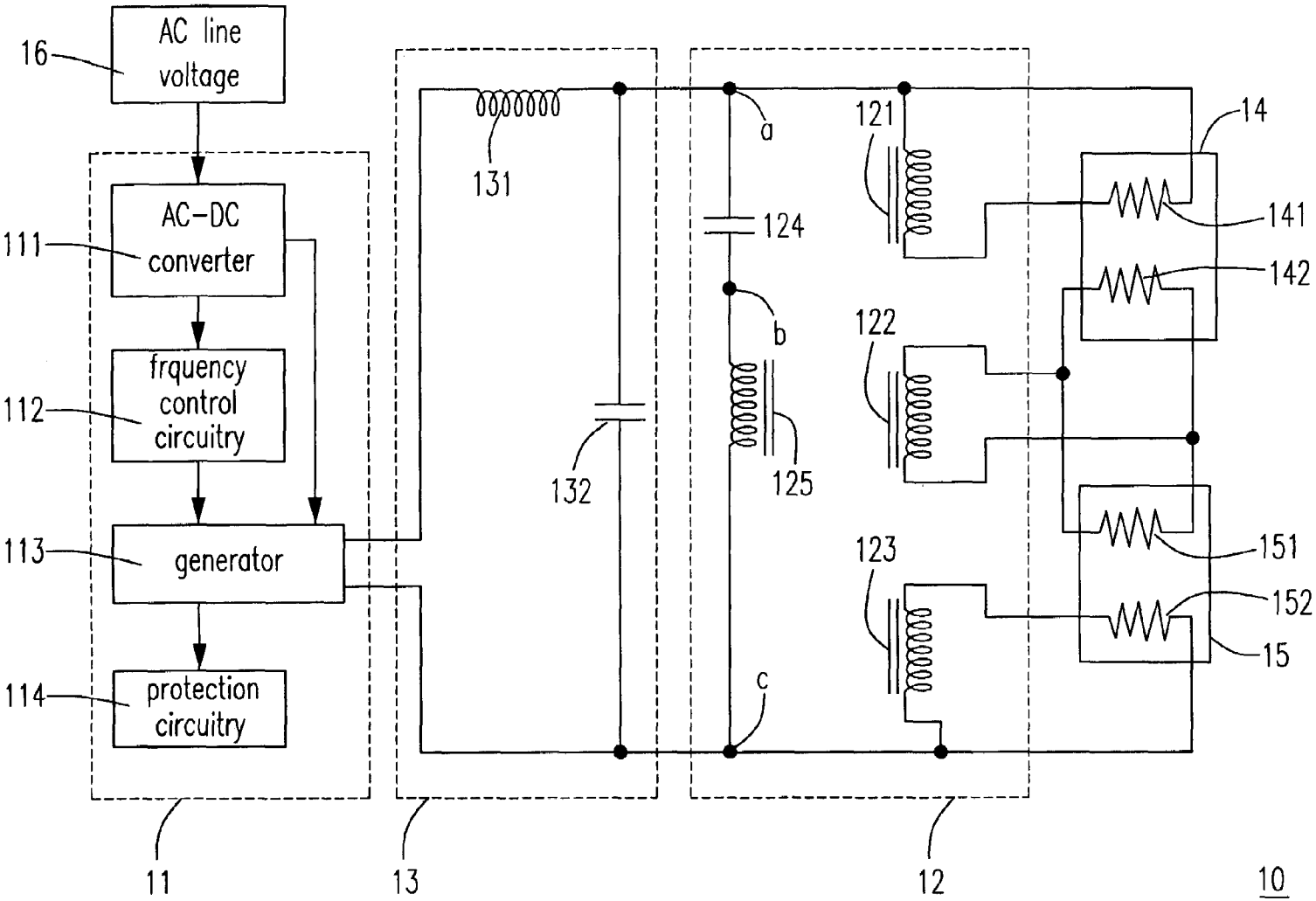
Fig. 1 (PRIOR ART)
FIG. 1 is a schematic diagram of a first conventional electronic ballast according to the prior art.
Figure 2:
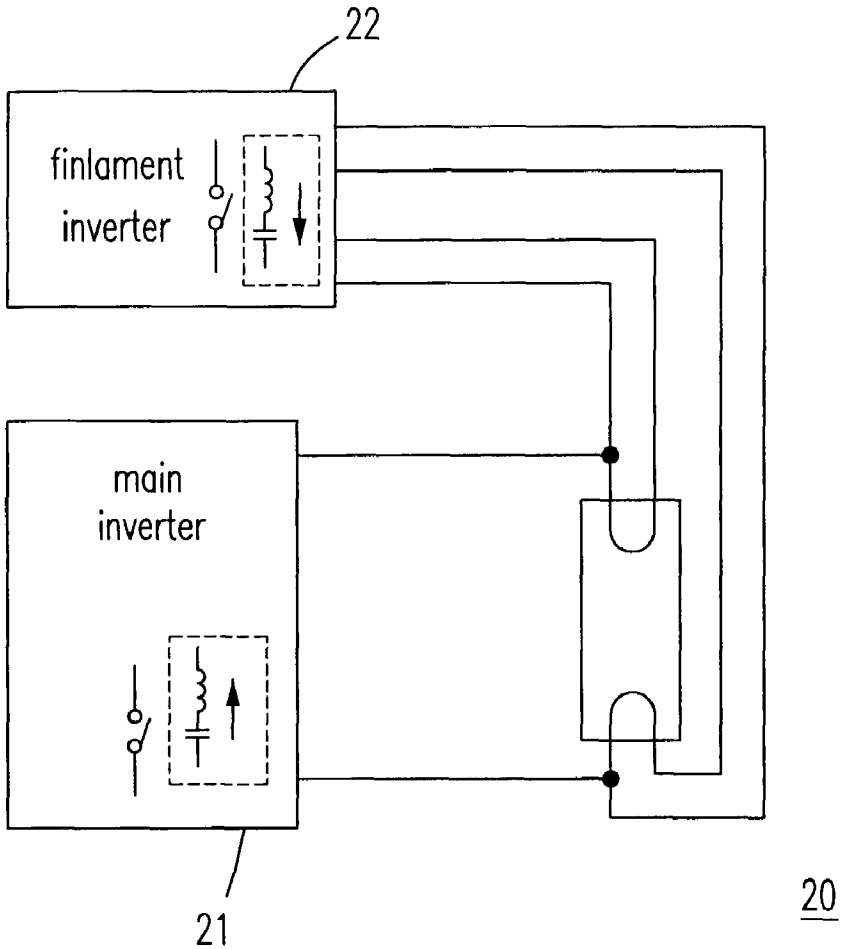
Fig. 2(PRIOR ART)
FIG. 2 is a schematic diagram of a second conventional electronic ballast according to the prior art.
Figure 3:
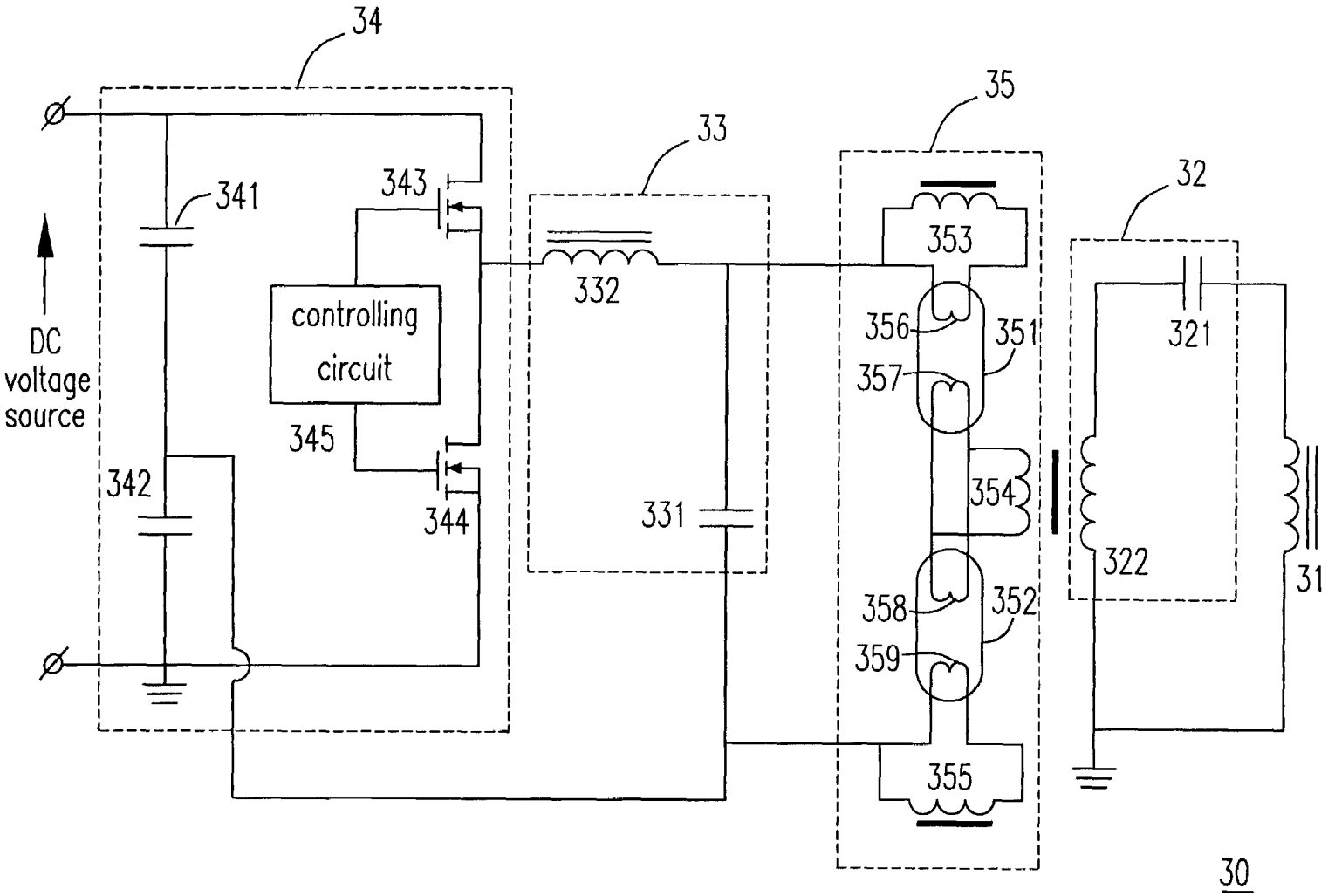
FIG. 3 is a schematic diagram of the first preferred embodiment of the electronic ballast in accordance with the present invention.

Please refer to FIG. 3, which shows a schematic diagram of the first preferred embodiment of the electronic ballast in accordance with the present invention. The electronic ballast 30 is composed of a pre-heating inductor 31, a first resonant circuit 32, a second resonant circuit 33, and a driving circuit 34. The electronic ballast 30 is for providing an electrical energy to a fluorescent lamp circuit 35.

An ordinary fluorescent lamp circuit of pre-heating type includes at least one fluorescent lamp and at least two pre-heating coils. In this invention, the fluorescent lamp circuit 35 includes two fluorescent lamps 351 and 352, and three pre-heating coils 353, 354, and 355. The fluorescent lamps 351 and 352 are connected to each other in series. The winding of each of the pre-heating coils 353, 354, and 355 is equal.

The first resonant circuit 32 includes a first resonant capacitor 321 and a first resonant inductor 322. The first resonant capacitor 321 is connected to the first resonant inductor 322 in series. The first resonant inductor 322 is connected with the pre-heating inductor 31 to the ground. The first resonant inductor 322 is magnetically coupled to the pre-heating coils 353, 354, and 355 so as to form a first transformer. The first resonant inductor 322 serves as the primary winding of the first transformer, and the pre-heating coils 353, 354, and 355 serve as the secondary winding of the first transformer.

The second resonant circuit 33 includes a second resonant capacitor 331 and a second resonant inductor 332. The second resonant capacitor 331 is connected to the fluorescent lamp circuit 35 in parallel. The second resonant inductor 332 is magnetically coupled to the pre-heating inductor 31 so as to form a second transformer. The second resonant inductor 332 serves as the primary winding of the second transformer, and the pre-heating inductor 31 serves as the secondary windings of the second transformer.

The driving circuit 34 includes two bus capacitors 341 and 342, two MOSFET switches 343 and 344, and a controlling circuit 345. The bus capacitors 341 and 342 are connected in series and coupled to a DC voltage source for serving as two DC blocking capacitors. The gate terminals of the MOSFET switches 343 and 344 which are connected in series are connected to the controlling circuit 345 respectively so as to make the driving circuit 34 switch the MOSFET switches 343 and 344 in turn for producing a square wave. The second resonant circuit 33 smoothes the square wave and makes a sinusoidal wave.

The operations of the electronic ballast 30 is described as below:

The controlling circuit 345 is programmed to produce a relatively higher frequency, about 70 KHz, which is near the natural resonant frequency of the first resonant capacitor 321 and the first resonant inductor 322. It causes a relatively large voltage drop across the first resonant inductor 322, which means that a relatively large current is provided to flow through the filaments 356, 357, 358, and 359 so as to pre-heat the fluorescent lamps 351 and 352 to reach a high cathode temperature.

After a period of the pre-heating stage, about one second, the controlling circuit 34 stably and continually decreases the resonant frequency to a low level, about 40 KHz. This frequency is near the natural resonant frequency of the second resonant capacitor 331 and the second resonant inductor 332, which means that the second resonant circuit 33 produces a relatively large voltage drop across the second resonant capacitor 331 to excite the fluorescent lamps 351 and 352.

Because the frequency of the pre-heating stage is nearly twice of the frequency of the exciting stage, the second resonant capacitor 331 is given a relatively small voltage drop across itself during the pre-heating stage. Therefore, the effect of the glow current which maybe occur in the fluorescent lamp can be eliminated so as to make the whole electronic ballast and the fluorescent lamps operate with a better performance.

After igniting the fluorescent lamps 351 and 352, the voltage drops across the fluorescent lamps 351 and 352 then decrease slightly until a stable level, and the fluorescent lamps 351 and 352 radiate. Not only the voltage drops across the filaments but also the currents through the filaments are decreased at this time. Comparing to the pre-heating stage, the voltage drop is actually very small, which is contributive to decrease the power dissipation of the fluorescent lamps and to prolong their lives at the same time.

Figure 4:
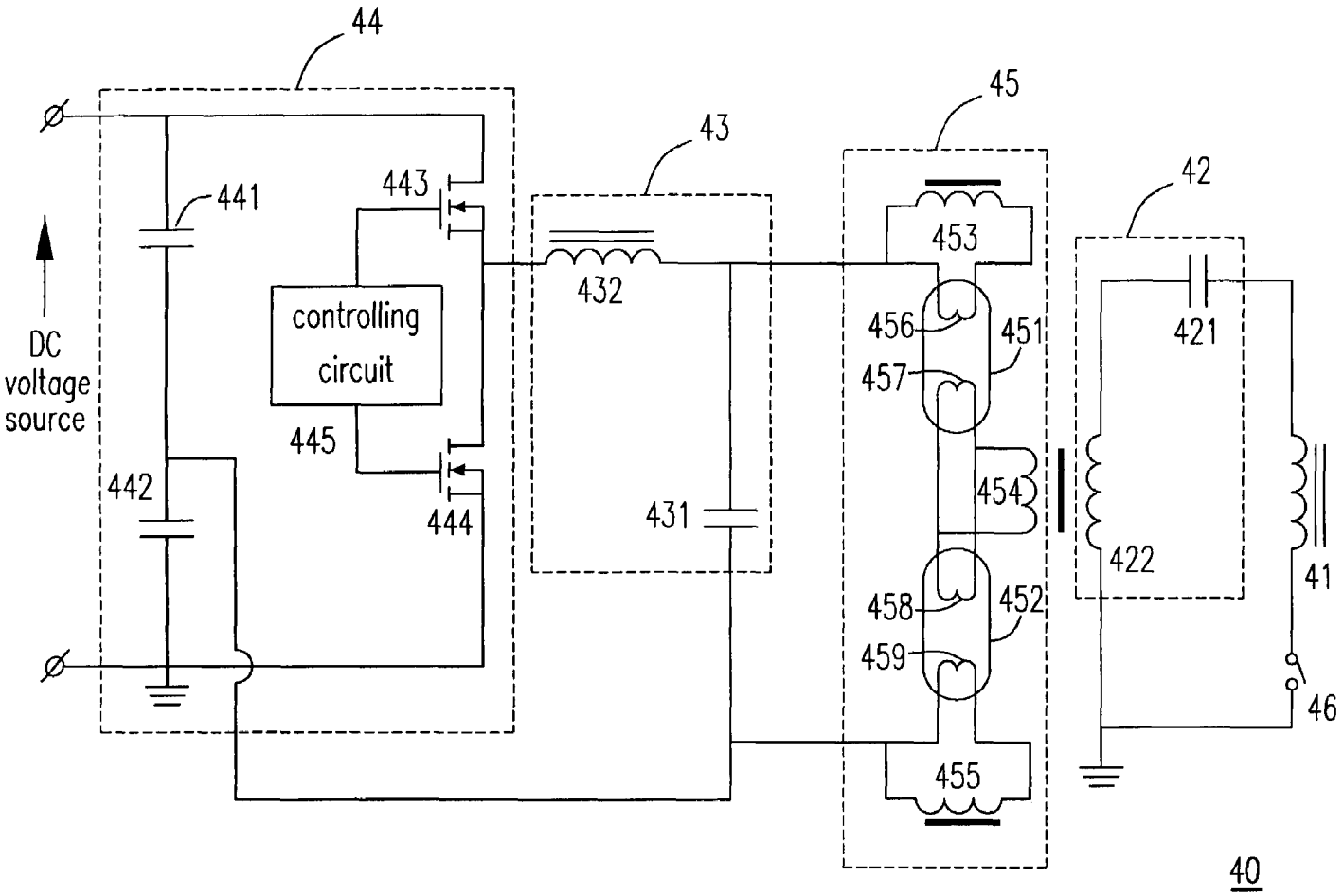
FIG. 4 is a schematic diagram of the second preferred embodiment of the electronic ballast in accordance with the present invention.

Please refer to FIG. 4, which shows a schematic diagram of the second preferred embodiment of the electronic ballast in accordance with the present invention. The only difference between FIG. 4 and FIG. 3 is that a switch 46 series-connected between the pre-heating inductor 41 and the ground is added into the electronic ballast 40.

The operations of the electronic ballast 40 is described as below:

In the pre-heating stage, the switch 46 must be turned on so as to make the first resonant circuit 42 operate normally. Once the fluorescent lamps 451 and 452 are ignited, e.g. radiated, the switch 46 must be turned off so as to eliminate the current flowing through the pre-heating inductor 41 and the fluorescent lamp circuit 45. The voltage drops across the filaments 456, 457, 458, and 459 then are decreased until almost 0 for eliminating the power dissipation occurred in the filaments. Besides, in order to decrease the voltage stress of the switch 46, the switch 46 must be turned on while in the ignited stage. If not, the high voltage occurred in the second resonant inductor 432 at that time and being coupled to the first resonant circuit 42 is definitely going to destroy the switch 46.

The invention is able to improve the prior arts effectively and eliminate the voltage drop across the filaments while in the normal operation stage. Of course, another switch can be utilized in the preceding patents to cut off the additional current flowing through their filaments, but the voltage stress will be high and the cost will consequently be high due to the different circuits. However, the pitfall can be overcome in the invention. Furthermore, the voltage across the filaments can still be reduced to a satisfied level, such as 1.6 V, even if no additional switch is added to this invention, which can be seen in the electronic ballast 30.

Comparing to the first conventional electronic ballast of the prior art, the invention has the advantage of the lower voltage stress occurring in the resonant capacitors of the preheating resonant circuits. Moreover, the current flowing through the filaments can be cut off just with a low voltage switch. Comparing to the second conventional electronic ballast of the prior art, the invention has the advantage of the lower power dissipation of the fluorescent lamps while in the normal operation stage.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. An electronic ballast for providing an electrical energy to a fluorescent lamp circuit, comprising:

a pre-heating inductor;

a first resonant circuit connected to said pre-heating inductor in parallel and coupled to said fluorescent lamp circuit for pre-heating said fluorescent lamp circuit according to a first resonant frequency;

a second resonant circuit coupled to said fluorescent lamp circuit for igniting said fluorescent lamp circuit according to a second resonant frequency; and a driving circuit coupled to said second resonant circuit for continuously providing said electrical energy to said second resonant circuit according to said second resonant frequency, wherein said first resonant circuit receives said electrical energy from said second resonant circuit.

2. The electronic ballast according to claim 1, wherein said fluorescent lamp circuit comprises at least a fluorescent lamp and at least two pre-heating coils, and the winding of each said pre-heating coil is equal.

3. The electronic ballast according to claim 2, wherein said first resonant circuit comprises a first resonant capacitor and a first resonant inductor connected in series, said first resonant capacitor being connected to the ground with said pre-heating inductor, said first resonant inductor serving as a primary winding of a first transformer, and each said pre-heating coil serving as a secondary winding of said first transformer.

4. The electronic ballast according to claim 3 further comprising a first switch connected between said pre-heating inductor and the ground in series and being turned on when said fluorescent lamp circuit is pre-heated by said first resonant circuit and turned off after said fluorescent lamp circuit is ignited by said second resonant circuit for eliminating a current passing through said pre-heating inductor and filaments of said fluorescent lamp circuit.

5. The electronic ballast according to claim 1, wherein said second resonant circuit comprises a second resonant capacitor connected to said fluorescent lamp circuit in parallel and a second resonant inductor serving as a primary winding of a second transformer, and said pre-heating inductor serves as a secondary winding of said second transformer.

6. The electronic ballast according to claim 4 wherein said driving circuit comprises:

a pair of blocking capacitors coupled to a DC voltage source and comprising a first blocking capacitor and a second blocking capacitor connected in series;

a pair of switches connected to said pair of blocking capacitors in parallel and comprising a second switch and a third switch connected in series, wherein said second switch and said third switch have a controlling terminal respectively; and a controlling circuit coupled to each said controlling terminal for switching said second switch and said third switch alternatively.

7. An electronic ballast for selectively eliminating a current passing through filaments of a fluorescent lamp circuit, comprising:

a pre-heating inductor;

a first resonant circuit connected to said pre-heating inductor in parallel and coupled to said fluorescent lamp circuit for pre-heating said fluorescent lamp circuit according to a first resonant frequency;

a second resonant circuit coupled to said fluorescent lamp circuit for igniting said fluorescent lamp circuit according to a second resonant frequency;

a driving circuit coupled to said second resonant circuit for continuously providing an electrical energy to said first resonant circuit and said second resonant circuit respectively according to said first resonant frequency and said second resonant frequency; and a first switch connected between said pre-heating inductor and the ground in series and being turned on when said fluorescent lamp circuit is pre-heated by said first resonant circuit and turned off after said fluorescent lamp circuit is ignited by said second resonant circuit for selectively eliminating said current passing through said pre-heating inductor and filaments of said fluorescent lamp circuit.

8. The electronic ballast according to claim 7, wherein said fluorescent lamp circuit comprises at least a fluorescent lamp and two pre-heating coils, and the winding of each said pre-heating coil is equal.

9. The electronic ballast according to claim 8, wherein said first resonant circuit comprises a first resonant capacitor and a first resonant inductor connected in series, said first resonant capacitor being connected to the ground with said pre-heating capacitor, said first resonant inductor serving as a primary winding of a first transformer, and each said pre-heating coil serving as a secondary winding of said first transformer.

10. The electronic ballast according to claim 7, wherein said second resonant circuit comprises a second resonant capacitor connected to said fluorescent lamp circuit in parallel and a second resonant inductor serving as a primary winding of a second transformer, and said pre-heating inductor serves as a secondary winding of said second transformer.

11. The electronic ballast according to claim 7, wherein said driving circuit comprises:

a pair of blocking capacitors coupled to a DC voltage source and comprising a first blocking capacitor and a second blocking capacitor connected in series;

a pair of switches connected to said pair of blocking capacitors in parallel and comprising a second switch and a third switch connected in series, wherein said second switch and said third switch have a controlling terminal respectively; and a controlling circuit coupled to each said controlling terminal for switching said second switch and said third switch alternatively.

12. A controlling method of an electronic ballast providing an electrical energy to a fluorescent lamp circuit, wherein said electronic ballast comprises a pre-heating inductor, a first resonant circuit connected to said pre-heating inductor in parallel and coupled to said fluorescent lamp circuit, a second resonant circuit coupled to said fluorescent lamp circuit, a driving circuit coupled to said second resonant circuit, and a switch connected between said pre-heating inductor and the ground in series, comprising the steps of:

turning on said switch through a first resonant frequency;

pre-heating said fluorescent lamp circuit according to said first resonant frequency by said first resonant circuit;

igniting said fluorescent lamp circuit according to a second resonant frequency by said second resonant circuit; and turning off said switch for eliminating a current passing through said pre-heating inductor and filaments of said fluorescent lamp circuit.

13. The controlling method according to claim 12, wherein said first resonant frequency and said second resonant frequency are provided by a controlling circuit.

14. The controlling method according to claim 13, wherein said controlling circuit respectively and continuously provides said first resonant frequency and said second resonant frequency.

15. The electronic ballast according to claim 1, wherein said first resonant circuit receives said electrical energy from said second resonant circuit via said pre-heating inductor.

16. The electronic ballast according to claim 15, wherein said second resonant circuit further comprises an inductive device and said pre-heating inductor is magnetically coupled to said inductive device to receive said electrical energy.

* * * * *